US006223840B1

(12) United States Patent
Swietlik

(10) Patent No.: US 6,223,840 B1
(45) Date of Patent: May 1, 2001

(54) CUTTING BED IMPELLER

(76) Inventor: George Swietlik, The Sandings Broadview Road, Oulton Broad, Lowestoft NR32 3PL (GB)

( * ) Notice: Subject to any disclaimer, the term of this patent is extended or adjusted under 35 U.S.C. 154(b) by 0 days.

(21) Appl. No.: 09/333,081

(22) Filed: Jun. 14, 1999

Related U.S. Application Data

(63) Continuation-in-part of application No. 08/877,881, filed on Jun. 18, 1997, now Pat. No. 5,937,957.

(51) Int. Cl.[7] ..... E21B 10/44

(52) U.S. Cl. ..... 175/323; 175/324; 175/325.4; 166/173

(58) Field of Search ..... 175/323, 325.1, 175/325.2, 325.3, 325.4, 325.5, 324; 166/173

(56) References Cited

U.S. PATENT DOCUMENTS

| | | | | |
|---|---|---|---|---|
| 3,268,274 | * | 8/1966 | Ortloff et al. | 175/325.4 |
| 3,285,678 | * | 11/1966 | Garrett et al. | 175/325.2 |
| 3,420,323 | * | 1/1969 | Owens | 175/323 |
| 4,245,709 | * | 1/1981 | Manuel | 175/325.5 |
| 4,277,869 | * | 7/1981 | Hartwell | 175/325.4 X |
| 4,384,626 | * | 5/1983 | Derouin | 175/325.4 X |
| 4,479,538 | * | 10/1984 | Coyle, Sr. | 166/173 |
| 4,489,793 | * | 12/1984 | Boren | 175/324 X |
| 4,540,055 | * | 9/1985 | Drummond et al. | 175/324 X |
| 4,757,861 | * | 7/1988 | Klyne | 175/323 X |
| 4,811,800 | * | 3/1989 | Hill et al. | 175/323 |
| 4,854,399 | * | 8/1989 | Zijsling | 175/323 X |
| 5,040,620 | * | 8/1991 | Nunley | 175/323 X |
| 5,937,957 | * | 8/1999 | Swietlik | 175/323 |

* cited by examiner

*Primary Examiner*—Eileen D. Lillis
*Assistant Examiner*—Jong-Suk Lee
(74) *Attorney, Agent, or Firm*—Seyfarth Shaw

(57) ABSTRACT

A cutting bed impeller comprises a body portion and a plurality of paddles projecting outwardly from the body portion, at least one of the paddles comprising a radially outer face extending between a leading edge and a trailing edge in a normal direction of rotation of the impeller about an axis of rotation of the cutting bed impeller, a leading face, and a trailing face. The radially outer face extends between the leading face and the trailing face. The leading face is inclined at a first angle $\alpha$ to a first tangent $T_1$ to the radially outer face at the leading edge. The trailing face is inclined at a second angle $\beta$ to a second tangent $T_2$ to the radially outer face at the trailing edge, the second angle $\beta$ being less than the first angle. The radially outer face of one or more of the paddles may be provided with one or more replaceable wear elements.

16 Claims, 3 Drawing Sheets

CUTTING BED IMPELLER

CROSS REFERENCE TO RELATED APPLICATION

This is a continuation-in-part of U.S. Ser. No. 08/877,881, filed Jun. 18, 1997, and entitled "CUTTING BED IMPELLER", U.S. Pat. No. 5,937,957, of which is hereby incorporated by reference.

BACKGROUND OF THE INVENTION

1. Field of the Invention

This invention relates to equipment for drilling operations.

2. Description of the Prior Art

In conventional drilling operations, mud or other drilling fluid is pumped down a hollow bore in the drill string and is ejected from the drill bit to lift the drill cuttings out of the bore-hole.

In an inclined well-bore it is been found that at a certain deviation or sail angle, some of the drill cuttings being transported back to the surface by the drilling fluid fall out of the main flow and settle on the lower portion of the bore-hole. These cuttings interfere with the drilling process and especially with the rotation of the rotating drill-pipe which also lies on the low side of the bore-hole.

The flow of returning drilling fluid which carries the cuttings is not uniform across the diameter of the bore-hole. On the low side of the bore-hole the flow is at a minimum and the capacity of the drilling fluid to transport drilling cuttings and solid particles is reduced.

To overcome this problem it is known to fit one or more cutting bed impellers to the drill-pipe. The impellers are integrally formed with a length of drill-pipe and comprise a body portion having a central longitudinal bore and a plurality of paddles in the form of single spiral blades which project radially outwardly from the body portion. These types of blade are similar in profile to those used on down-hole drilling stabilizers.

As the cutting bed impeller rotates with the drill-pipe, it disturbs and agitates the settled cuttings and other particles and moves them upwards into the path of the main flow of cutting fluid on the upper side of the bore-hole. Although these tools have proved reasonably effective they have been found to create extra down-hole torque.

SUMMARY OF THE INVENTION

According to the present invention there is provided a cutting bed impeller comprising a body portion and a plurality of paddles projecting outwardly from the body portion, at least one of the paddles comprising:

- a radially outer face extending between a leading edge and a trailing edge in a normal direction of rotation of the impeller about an axis of rotation of the impeller;
- a leading face; and
- a trailing face, the radially outer face extending between the leading face and the trailing face, the leading face being inclined at a first angle to a first tangent to the radially outer face at the leading edge, the trailing face being inclined at a second angle to a second tangent to the radially outer face at the trailing edge, the second angle being less than the first angle.

Each paddle is preferably substantially straight.

A recess comprising a depression may be formed in the leading face of the paddle. Each recess is preferably from ¼" to 2" (6.4 to 51 mm) deep.

Preferably the cutting bed impeller comprises part of a drill string sub, rather than a complete length of drill-pipe. Preferably the wall thickness of the sub is reduced on one or both sides of the cutting bed impeller. This reduced thickness portion accommodates bending due to high side forces which may be generated on the sub.

The provision of the cutting bed impeller on a sub allows the tool to be run in conjunction with or immediately between bearing devices or torque reduction tools. This is not possible with a conventional cutting bed impeller, which is integrally formed with a length of drill-pipe.

The radially outer face of the paddles may be provided with replaceable wear elements. These wear elements may comprise nylon inserts fitted into openings in the radially outer faces of the paddles. The nylon inserts may be cylindrical and may fit within blind bores in the paddles. In another embodiment, the wear elements comprise wear pads which fit within slots formed through the paddles. Alternatively, the replaceable wear elements may comprise any appropriate shape or size of element of elements which may be used to protect the cutting bed impeller from abrasion with the wall of the bore-hole and/or which reduce the down-hole torque.

Preferably the wear elements comprise approximately 60% of the total area of the radially outer face of the or each paddle.

The recesses defined between respective paddles act as scoops to lift cuttings and solid particles from the lower portion of the bore-hole into the main flow of cutting fluid in the upper portion of the bore-hole. The effectiveness of the impeller is governed by the size of the clearance between the radially outer faces of the paddles and the bore-hole wall and the profile of the recess.

According to another aspect of the present invention there is provided a cutting bed impeller comprising a body portion and a plurality of paddles projecting from the body portion, replaceable wear elements being provided on the radially outer faces of one or more of the paddles.

Preferably, replaceable wear elements are disposed equidistantly around the circumference of the impeller to ensure an even bearing in the bore-hole. For example, they may be provided on oppositely disposed pairs of paddles.

A plurality of cutting bed impellers may be fitted to a drill string. The cutting bed impellers are preferably spaced apart at 90 m to 150 m (300 ft. to 500 ft.) intervals.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENTS

Figure 1:
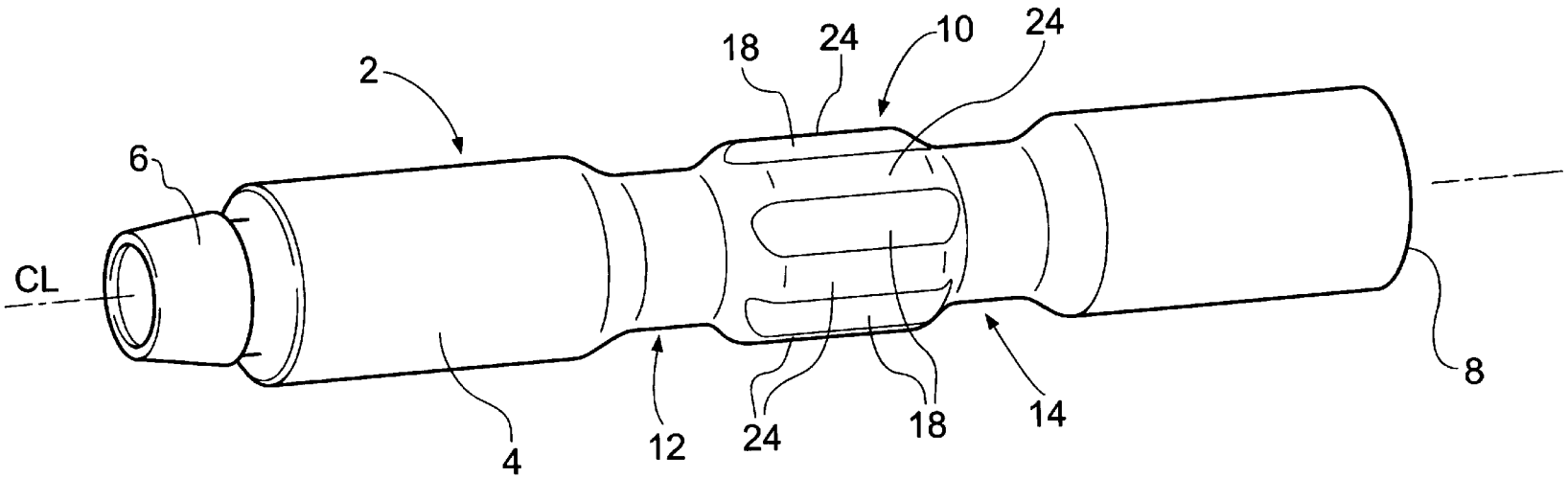
FIG. 1 is a perspective view of part of a drill string sub.
Figure 2:
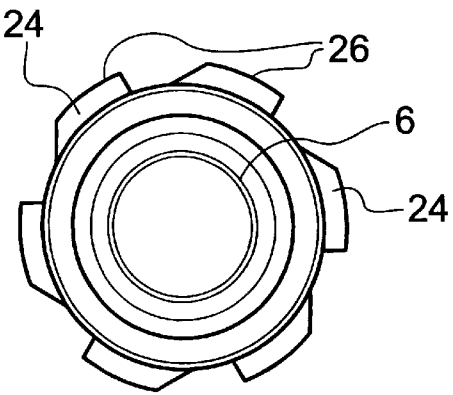
FIG. 2 is an end view of the drill-string sub of FIG. 1 taken from the left-hand end thereof.

Referring to FIGS. 1 and 2, a drill string sub 2 comprising a hollow cylindrical sleeve 4 has a male connector or pin 6 at one end and a female connector or box 8 at the other end. A cutting bed impeller 10 is integrally formed with the sleeve 4 at an intermediate point along its length. On either side of the cutting bed impeller 10, the sleeve 4 has a reduced external diameter which provides bending zones 12, 14 which enable the drill string sub to accommodate the reverse bending forces which are generated as the sub 2 rotates in the curve of a deviated bore-hole.

As best shown in FIG. 1, the cutting bed impeller 10 comprises a substantially cylindrical body portion into which are machined five substantially straight grooves 18 which extend parallel to the rotational axis CL of the drill string sub.

Respective pairs of adjacent grooves 18 define respective straight paddles 24 which also extend parallel to the rotational axis CL and project substantially outwardly. Each paddle 24 has a radially outer face 26 (seen best in FIGS. 2 and 4) which is received with some play in the bore-hole.

Figure 3:
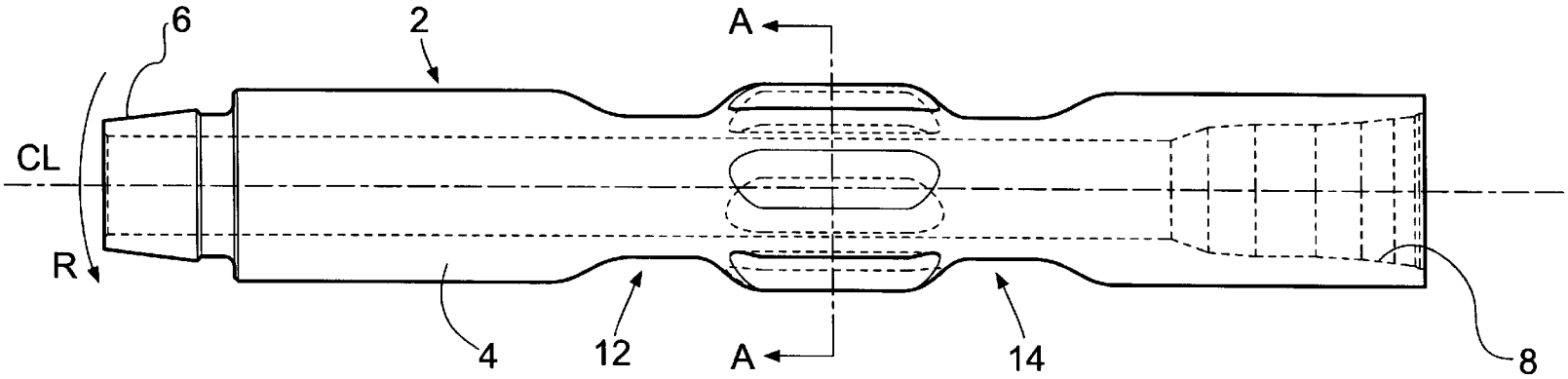
FIG. 3 is a plan view of the drill-string sub of FIG. 1 showing hidden detail.
Figure 4:
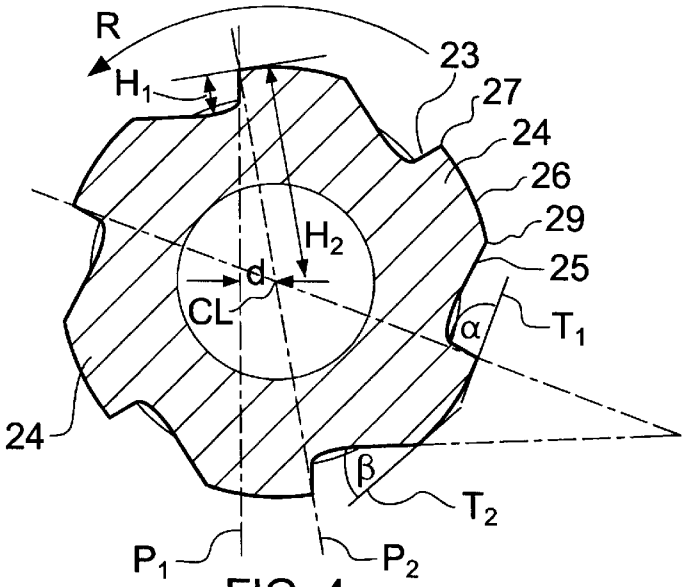
FIG. 4 is an enlarged cross-section through the drill string sub taken generally along the line IV—IV in FIG. 3.

Referring to FIGS. 3 and 4, each paddle 24 is further bounded by a respective leading face 23 and a respective trailing face 25, the terms "leading" and "trailing" being defined with respect to the normal direction of rotation, depicted by arrow R in FIGS. 3 and 4, of the cutting bed impeller about the axis CL. The line of intersection between the leading face 23 and the radially outer face 26 of each paddle 24 defines a respective leading edge 27 and the line of intersection between the trailing face 25 and the radially outer face 26 of each paddle 24 defines a respective trailing edge 29.

In an illustrated embodiment, all of the paddles 24 are identical and each is configured as follows. The leading face is inclined at a first angle $\alpha$ to a first tangent $T_1$, to the radially outer face 26 at the leading edge 27, and the trailing face 25 is inclined at a second angle $\beta$ to a second tangent $T_2$, to the radially outer face 26 at the trailing edge 29. As best shown in FIG. 4, the second angle $\beta$ is less than the first angle $\alpha$.

It will be appreciated that respective grooves 18 are defined by a trailing face 25 of a first paddle 24 and a leading face of the next paddle 24 and act as the "buckets" or "scoops" of the cutting bed impeller 10.

The angle $\alpha$ is preferably between about 60 and about 120° and is most preferably greater than or equal to about 70° to provide an enhanced "scooping" action when the cutting bed impeller 10 rotates in the direction R. The angle $\beta$ is always less than the angle $\alpha$, and is preferably less than about 90° and is most preferably between about 20 and about 40°.

In the illustrated embodiment, which provides a particularly effective "scooping" action, the angle $\alpha$ is approximately 80°, so that a plane $P_1$ containing the leading face 23 does not intersect the axis of rotation CL, but rather is offset from it and forms an angle of approximately 10° with a plane $P_2$ extending between the leading edge 27 of the respective paddle 24 and the axis of the rotation CL. The offset (d), as measured along a radial line perpendicular to $P_1$ is preferably less than or equal to about 2".

Referring to FIG. 4, the height $H_1$ of each paddle 24, as measured from the first tangent $T_1$ to the portion of groove 18 closest to the axis CL, is preferably one quarter to one ninth of the radius $H_2$ of the cutting bed impeller. A particularly effective compromise is achieved when $H_1$ is about one sixth of $H_2$. At this size ratio, the cutting bed impeller 10 provides an effective scooping action, but is unlikely to become jammed by large pieces of debris which might be entrained in the fluid flow around the impeller.

Figure 5:
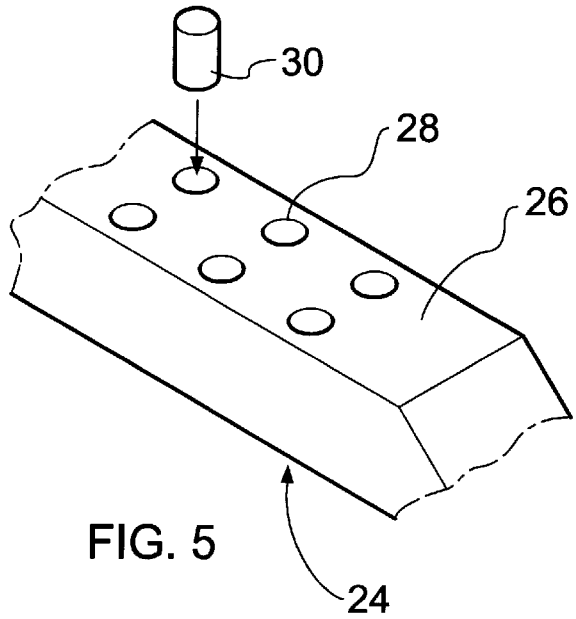
FIG. 5 is an enlarged perspective view of a paddle having cylindrical replaceable wear elements.

FIG. 5 shows another embodiment of paddle 24 which is provided with a plurality of blind bores 28. Respective cylindrical replaceable wear elements 30 are located in each bore 28, such that they project slightly from the radially outer face 26 of the paddles 24. The wear elements 30 provide a replaceable bearing surface which protects the cutting bed impeller 10 from abrasion against the wall of the bore-hole and reduces down-hole torque.

Figure 6:
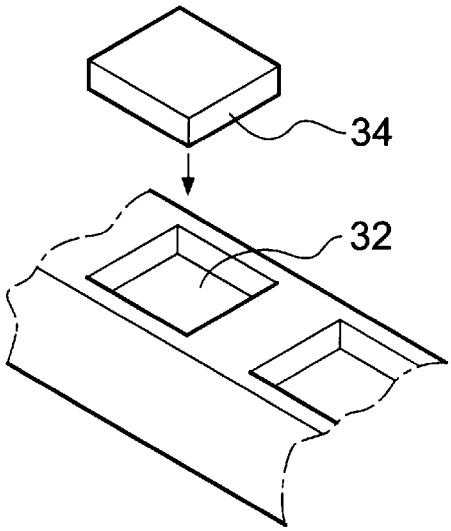
FIG. 6 shows an alternative form of paddle having rectangular replaceable wear elements.

FIG. 6 shows another embodiment of the paddle 24 which is provided with cut outs 32 in which are located square replaceable wear elements 34.

Figure 7:
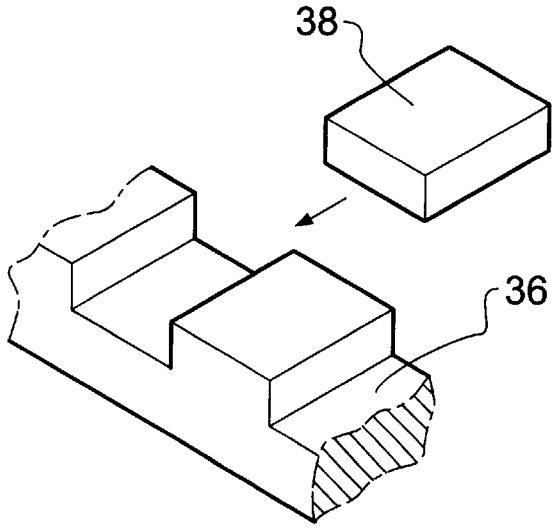
FIG. 7 shows an alternative embodiment of paddle using square replaceable wear elements.

FIG. 7 shows a final embodiment of paddle 24 in which are machined transverse slots 36. Rectangular replaceable wear elements 38 are located in the slots and are held in place by adhesive, by screws or by any other appropriate fixing means.

The replaceable wear elements 30, 34, 38 are preferably made of nylon, but any other appropriate material may be used and any shape of wear element is contemplated.

In use, the drill string sub 2 is fitted to a drill pipe and is rotated in the direction R indicated by arrow R in FIGS. 3 and 4, as drilling proceeds. Drilling fluid is pumped down the hollow interior of the drill-pipe and is ejected at the drill bit to force cuttings and other solid particles up and out of the bore-hole.

As the cutting bed impeller 10 rotates, cuttings and other solid particles lying on the lower portion of the bore-hole are caught against the leading faces 23 of the paddles 24 and are scooped upwards into the main flow of drilling fluid where they become entrained in the flow. The zones 12, 14 act as clearance areas for the turbulence created by the paddles 24 in lifting the debris to the high side of the hole. Consequently, the bore-hole is kept cleaner with less debris accumulating on the low side of the hole, so that there is less sliding friction when picking up or lowering the drill string.

The asymmetrical cross-section of the recesses 18 defined by respective pairs of adjacent paddles 24 results in a very efficient blade profile which enhances the scooping/pumping action of the impeller.

In the illustrated embodiment, the recesses 18 which scoop up the cuttings and other solid particles are defined between the trailing face 25 of a first paddle 24 and the leading face 23 of the next paddle 24. However, it is contemplated that these recesses could be extended by depressions formed in the leading face 23 of each paddle 24, thereby enhancing the scooping action.

If the paddles 24 are provided with replaceable wear elements, which can be renewed periodically, the service life of the cutting bed impeller 10 is greatly increased. Furthermore, the replaceable wear elements reduce the drag on the walls of the bore-hole, thereby reducing the down-hole torque.

If the cutting bed impeller 10 is carried on a short drill-string sub it can be run in conjunction with or immediately between bearing devices or torque reduction tools, so that a further reduction in down-hole torque is possible. It is however contemplated that the cutting bed impeller 10 could also be formed on a length of drill-pipe, particularly as the provision of replaceable wear elements provides a torque reduction function.

Though in all the above-illustrated embodiments the paddles of each impeller are identical to one another, it is contemplated that only some of the paddles of an impeller may provide a scooping action and/or be provided with replaceable wear elements.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A cutting bed impeller comprising a body portion and a plurality of substantially straight paddles projecting outwardly from the body portion and extending in a direction substantially parallel to the rotational axis of the cutting bed impeller, at least one of the paddles comprising:

a radially outer face extending between a leading edge and a trailing edge in a normal direction of rotation of the impeller about the rotational axis of the impeller;

a leading face; and a trailing face, the radially outer face extending between the leading face and the trailing face, the leading face being inclined at a first angle to a first tangent to the radially outer face at the leading edge, the trailing face being inclined at a second angle to a second tangent to the radially outer face at the trailing edge, the second angle being less than the first angle.

2. A cutting bed impeller as claimed in claim 1, in which the first angle is greater than or equal to about 60°.

3. A cutting bed impeller as claimed in claim 2, in which the first angle is less than or equal to about 120° and greater than or equal to about 70°.

4. A cutting bed impeller as claimed in claim 3, in which the first angle is about 80°.

5. A cutting bed impeller as claimed in claim 1, in which the second angle is less than about 90°.

6. A cutting bed impeller as claimed in claim 5, in which the second angle is greater than or equal to about 20° and less than or equal to about 40°.

7. A cutting bed impeller as claimed in claim 1, in which the paddles are substantially straight.

8. A cutting bed impeller as claimed in claim 1, in which each paddle extends along the body portion in a direction parallel to the normal rotational axis of the cutting bed impeller.

9. A cutting bed impeller as claimed in claim 1, in which each paddle has a depression formed in its leading face.

10. A cutting bed impeller as claimed in claim 1, comprising part of a drill string sub.

11. A cutting bed impeller as claimed in claim 10, in which the wall thickness of the sub is reduced on one or both sides of the cutting bed impeller.

12. A cutting bed impeller as claimed in claim 1, in which the radially outer face of each paddle is provided with a replaceable wear element.

13. A cutting bed impeller as claimed in claim 12, in which each wear element comprises a nylon insert fitted into an opening in the radially outer face of the respective paddle.

14. A cutting bed impeller as claimed in claim 13, in which the nylon insert is cylindrical and is fitted within a blind bore in the paddle.

15. A cutting bed impeller as claimed in claim 13, in which each wear element is received within a slot formed through the respective paddle.

16. A cutting bed impeller comprising a body portion and a plurality of substantially straight paddles projecting outwardly from the body portion and extending in a direction substantially parallel to the rotational axis of the cutting bed impeller, at least one of the paddles comprising:

a radially outer face extending between a leading edge and a trailing edge in a normal direction of rotation of the impeller about the rotational axis of rotation of the impeller;

a leading face; and a trailing face, the radially outer face extending between the leading face and the trailing face, a depression being formed in said leading face to enhance a scooping action of the cutting bed impeller.

* * * * *

UNITED STATES PATENT AND TRADEMARK OFFICE

CERTIFICATE OF CORRECTION

PATENT NO. : 6,223,840 B1
DATED : May 1, 2001
INVENTOR(S) : George Swietlik

It is certified that error appears in the above-identified patent and that said Letters Patent is hereby corrected as shown below:

Please add in field (56) References Cited, the following references which were omitted:

-- 5,570,742 11/1996 Reynolds et al. ..... 166/173

FOREIGN PATENT DOCUMENTS

| | | |
|---|---|---|
| 2,047,775 | 12/1980 | United Kingdom. |
| 2,061,358 | 5/1981 | United Kingdom. |
| 2,133,059 | 7/1984 | United Kingdom. -- |

Signed and Sealed this

Eighteenth Day of September, 2001

*Attest:*

Nicholas P. Godici

NICHOLAS P. GODICI

*Attesting Officer*

*Acting Director of the United States Patent and Trademark Office*